US005918967A

United States Patent [19]

Land

[11] Patent Number: 5,918,967

[45] Date of Patent: Jul. 6, 1999

[54] DECORATIVE LAMP CASINGS AND LAMP BULB ENVELOPES

[76] Inventor: Glenn E. Land, 3221 Old River La., Rte. 2, Box 338, Independence, Va. 24348

[21] Appl. No.: 08/915,837

[22] Filed: Aug. 20, 1997

[51] Int. Cl.[6] ..... F21P 1/02

[52] U.S. Cl. ..... 362/255; 362/294; 362/806

[58] Field of Search ..... 362/255, 256, 362/806, 294

[56] References Cited

U.S. PATENT DOCUMENTS 2,749,432 6/1956 Dorsey ..... 362/255

4,300,068 11/1981 Baird et al. ..... 313/315

5,180,224 1/1993 Svehaug ..... 362/255

5,359,506 10/1994 Koleno ..... 362/806

*Primary Examiner*—Stephen Husar

*Attorney, Agent, or Firm*—Jones, Tullar & Cooper, PC

[57] ABSTRACT

Decorative lamp casings and lamp bulb envelopes create a desired effect, such as an icicle effect. The lamp casings comprise a single element or component shaped like an icicle that is capable of being slid over a lamp bulb and secured to the outer surface of the existing lamp bulb, lamp socket or lamp assembly. The lamp bulb envelope comprises a conventional electrical lamp base wherein the lamp bulb envelope is in the shape of an icicle. The icicle effect is enhanced by simulated frozen water runs on the outer surface of the casing or envelope.

7 Claims, 4 Drawing Sheets

DECORATIVE LAMP CASINGS AND LAMP BULB ENVELOPES

BACKGROUND OF THE INVENTION

The present invention relates to decorative lamp casings and lamp bulb envelopes which are capable of creating an icicle effect.

A variety of decorative lamp casings and lamp bulb envelopes are known and available on the market. Consumers are always looking for new and unique articles or products for decorative purposes such as for Christmas tree ornaments and the like. While a variety of decorative lamp casings and envelopes are available, there are a number of disadvantages in such prior art devices.

Most prior art lamp casings are designed for connection to a particular lamp or lamp assembly, and can only be used with that particular lamp assembly. Further, many prior art lamp casings consist of a plurality of components or elements that must be assembled, while some prior art decorative lamp casings are fastened to lamps or lamp sockets by adhesives and cannot be easily or conveniently removed when a lamp needs replacing. Lamp bulb envelopes are fabricated as an integral part of a lamp, and may be produced in various decorative shapes and sizes to meet the needs of the consumer. But such prior envelopes and casings have not met the need for a tree ornament that simulates the shape and appearance of an icicle.

SUMMARY OF THE INVENTION

An object of the present invention is to fulfill the need and desire for new and unique decorative articles for Christmas tree lights and the like.

It is a primary object of the present invention to provide a lamp casing or a lamp bulb envelope capable of creating a desired effect, such as the icicle effect.

It is also a primary object of the present invention to provide a decorative lamp casing that consists of a single element or component which can easily be slid over or removed from a lamp and secured to the outer surface of a wide variety of existing lamp sockets or lamp assemblies without requiring separate elements or fasteners.

A further object of the present invention is to provide a decorative lamp casing that creates insulation between heat radiating from a lamp and adjacent flammable objects or material such as Christmas trees, curtains and the like.

It is another primary object of the present invention to provide a lamp bulb envelope capable of creating an icicle effect having a typical or conventional electrical lamp base that is compatible with a wide variety of typical lamp bulb sockets.

A further object of the present invention is to provide a lamp bulb envelope capable of creating an icicle effect, that has an elongated, generally conical shape similar to that of an icicle.

In one preferred embodiment, the invention comprises a single element or component including a hollow lamp casing resembling an icicle in that it is elongated and generally conical and includes irregularities in the form of multiple elongated, short, protruding, smoothly rounded ridges which simulate frozen water runs on its outer surface. The lamp casing has a neck region that is cylindrical and flanged outwardly at its open top. The neck region has a plurality of open-ended slots extending from its open top in a downward direction to produce multiple elongated spring-like fingers which enable the neck region to flex outwardly when the lamp casing is being installed over a lamp. The same flexibility of the neck region causes the fingers to tend to return to their original position and creates the engaging forces that secure the lamp casing in place.

In another preferred embodiment, the invention comprises a lamp including a typical lamp base and an elongated, generally conical lamp bulb envelope permanently secured to the lamp base and enclosing a conventional electric filament. The lamp bulb envelope includes multiple elongated, short, protruding, smoothly rounded longitudinally extending ridges simulating frozen water runs which enhance the creation of an icicle effect.

BRIEF DESCRIPTION OF DRAWINGS

The foregoing, and additional objects, features and advantages of the present invention will be more fully understood by reference to the following detailed description of preferred embodiments thereof, taken in conjunction with the accompanying drawings, in which.

CASING DESCRIPTION OF PREFERRED EMBODIMENTS

Figure 2:
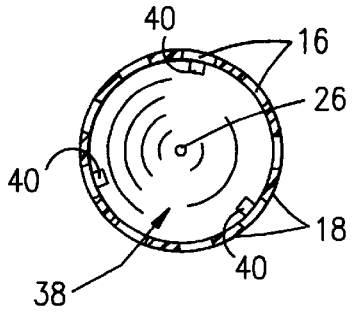
FIG. 2 is an end view of the decorative lamp casing taken at line 2—2 of FIG. 1, illustrating the casing slots and fingers.
Figure 1:
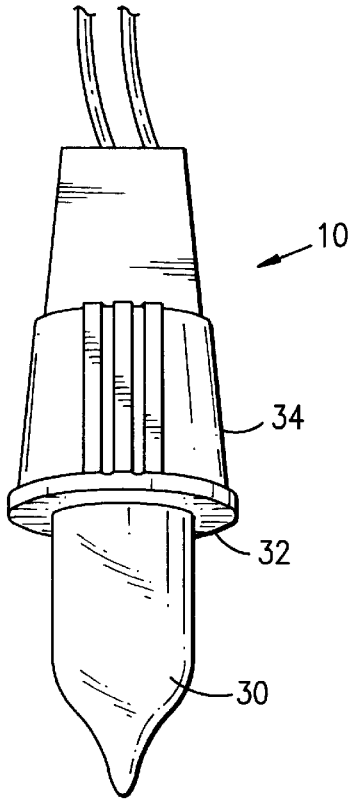
FIG. 1 is an exploded side elevation view of a preferred embodiment of the present invention, illustrating the features of a decorative lamp casing in combination with a conventional lamp and lamp socket.
Figure 3:
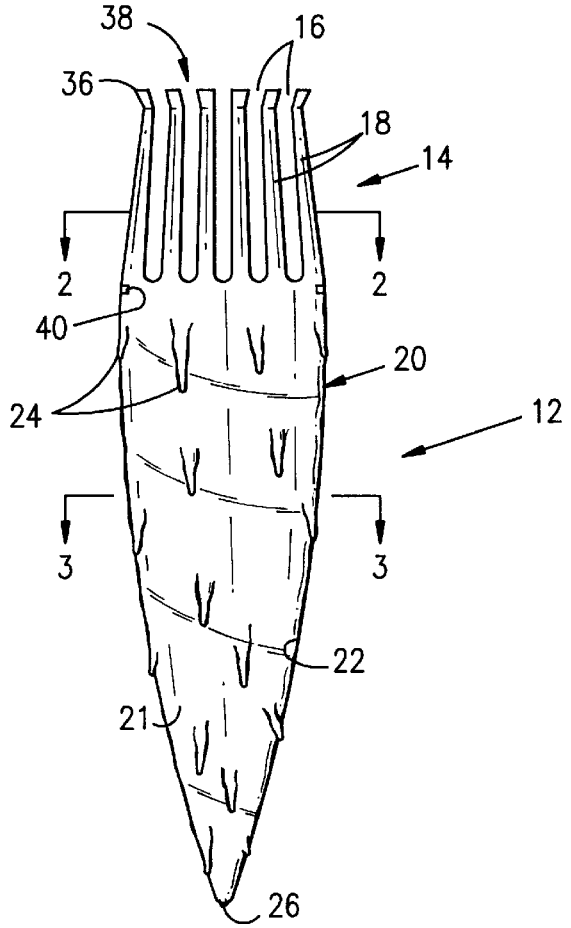
FIG. 3 is a cross-sectional view of a decorative lamp casing taken at line 3—3 of FIG. 1, illustrating the inner surface and the outer surface having simulated frozen water runs.
Figure 3:
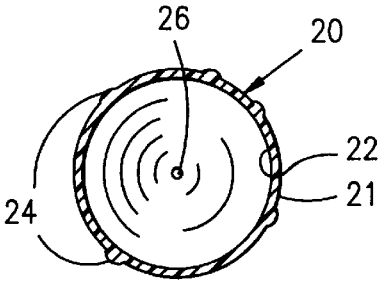

Turning now to a more detailed consideration of the present invention, there is illustrated in FIGS. 1–3 a lamp socket generally indicted at 10 and a casing 12 for connection to the socket. The casing preferably is manufactured of material such as flexible, heat resistant plastic, or the like. The features and characteristics of the lamp casing 12 include a neck region generally indicated at 14 including longitudinally extending slots 16 spaced around the neck to form elongated, longitudinally extending flexible fingers 18. The lower portion of the lamp casing 12, below the neck region 14, includes an elongated, generally conical hollow body 20 having a shape generally similar to that of an icicle. The body has an outer surface 21 and an inner surface 22 (see FIG. 3), and multiple elongated, rounded, spaced ridges 24 shaped to simulate frozen water runs on the outer surface 21. A drain hole 26 is provided at the lowermost point of body 20.

The conventional lamp and lamp socket, generally indicated at 10, includes a lamp 30, a lamp base rim 32 and a socket 34, and is shown for the purpose of facilitating the description of the lamp casing 12.

The fingers 18 formed in the neck region 14 of the lamp casing 12, extend in a generally upward direction from the body 20, with the terminal, or top ends of the fingers 18 having flanges 36 projecting in a generally outward direction. The outward projections 36 provide sloping surfaces to facilitate the engagement of the neck region 14 of the lamp casing 12 with the lamp and lamp socket 10. The slots 16 extend from the open top 38 of the casing 12 into the neck region 14 in a downwardly direction, generally parallel to the axis of the casing, to enable the fingers 18 to flex when the lamp casing 12 is being attached or installed over a typical lamp and lamp socket 10. The flexibility of the fingers 18 is a function of the material of the casing 12, its thickness, and the width and length of the fingers, and is selected to produce engaging forces in the fingers sufficient to secure the lamp casing 12 to the typical lamp and lamp socket 10.

The simulated frozen water runs 24 on the outer surface 20 of the body portion are ridges which are preferably molded as a part of the body portion 20, and may be substantially identical, but preferably will each be slightly different in size and shape. Each ridge is elongated, irregular in shape, and is generally parallel to the axis of body 20. The plural ridges are spaced around the circumference of body 20 and along its length to simulate an icicle. The drain hole 26 facilitates the drainage of any moisture which might collect in the casing and allows the lamp casing 12 to breath.

The lamp casing 12 is attached to the lamp and lamp socket by sliding the fingers 18 over the lamp 30 and the lamp base rim 32. Stops 40 are provided on the inner surface 22 of the casing to limit the motion of the casing onto the lamp by contacting base rim 32. The flexibility of the fingers in the neck region 14 then urges the fingers inwardly to secure the lamp casing 12 to the lamp and lamp socket 10.

Figure 4:
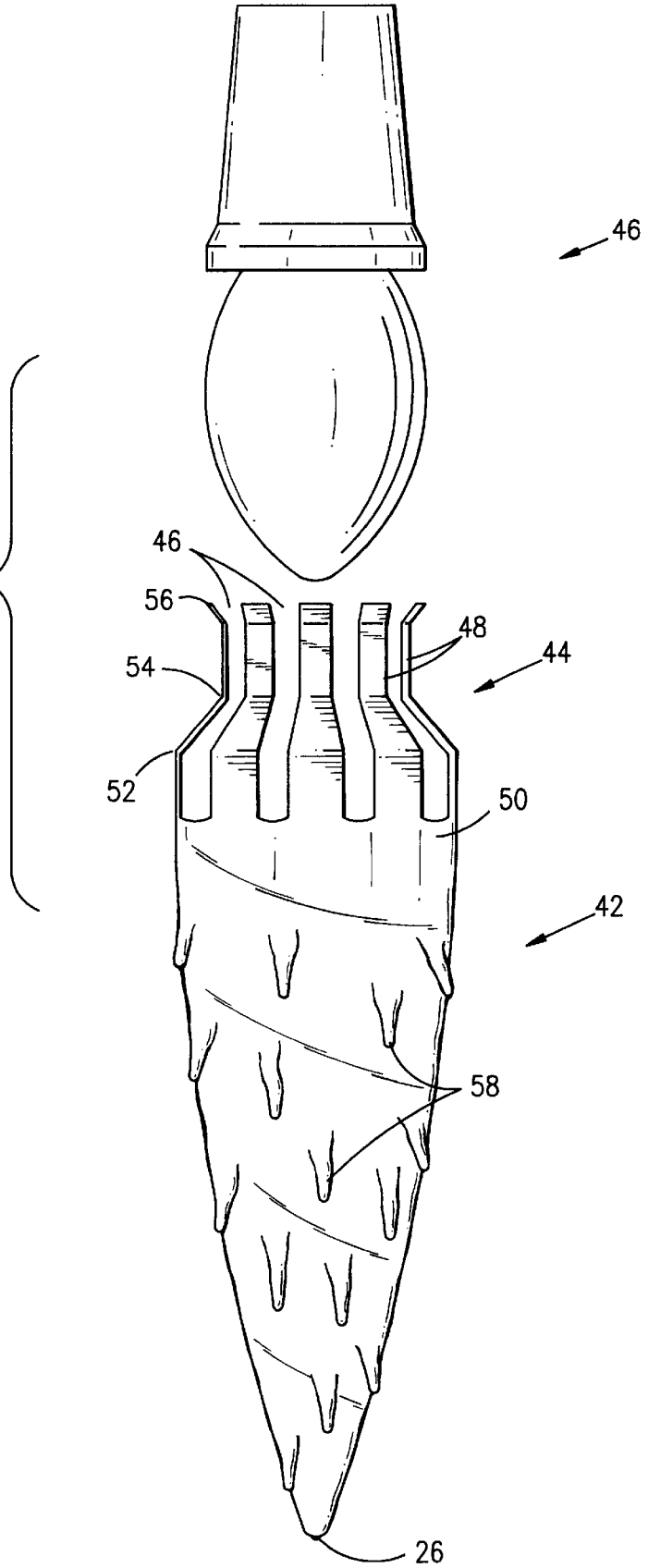
FIG. 4 is an exploded side elevation view of a second embodiment of the invention, showing a decorative lamp casing having a modified neck region to facilitate connection to different lamps and lamp sockets.

FIG. 4 is a side elevation view of a second embodiment of the present invention illustrating a modified lamp casing 42 having a modified neck region, generally indicated at 44, to facilitate the attachment of the lamp casing to a larger or different variety of lamp and lamp socket, as generally indicated at 46. As illustrated in FIG. 4, the neck region 44 includes fingers 48 which extend upwardly a short distance from the body portion 50 and then angle inwardly at a first bend 52 to a second bend indicated at 54. From bend 54, the fingers continue in an upwardly direction and terminate at flanges 56 which slope in a generally outward direction.

The body portion 50 of the lamp casing 42 preferably is similar in appearance to that of the envelope illustrated in FIG. 1, although it may be slightly larger to accommodate larger lamps 46, and thus includes multiple simulated water runs 58 spaced around the casing. If the lamp casing 42 is to be used in conjunction with a typical outdoor lamp and lamp socket, then a drain hole 26 is desirable.

The lamp casing 42 can incorporate other modifications to facilitate its compatibility with a wide variety of lamps and lamp sockets. For example, a clip or other fastener may be included for attaching the lamp casing to such items as Christmas tree limbs and the like. In addition, the body portion of the decorative lamp casing could simulate a wide variety of items, articles, and characters such as pumpkins, rabbits, hearts, angels, snow men, turkey, and the like, as desired, to meet seasonal or other decor requirements.

It will be understood that the simulated frozen water runs of the preferred embodiment may be altered or modified from those illustrated in the drawings, and the lengths of the lamp casings may vary. The lamp casing may be clear, translucent, frosted, generally smooth or roughened, etched, for example, and can incorporate both transparent and nontransparent diffusing regions on its surface to enhance or alter a decorative effect as may be desired. The same can be facilitated by using various materials, color pigments, abrading, and the like.

Figure 5:
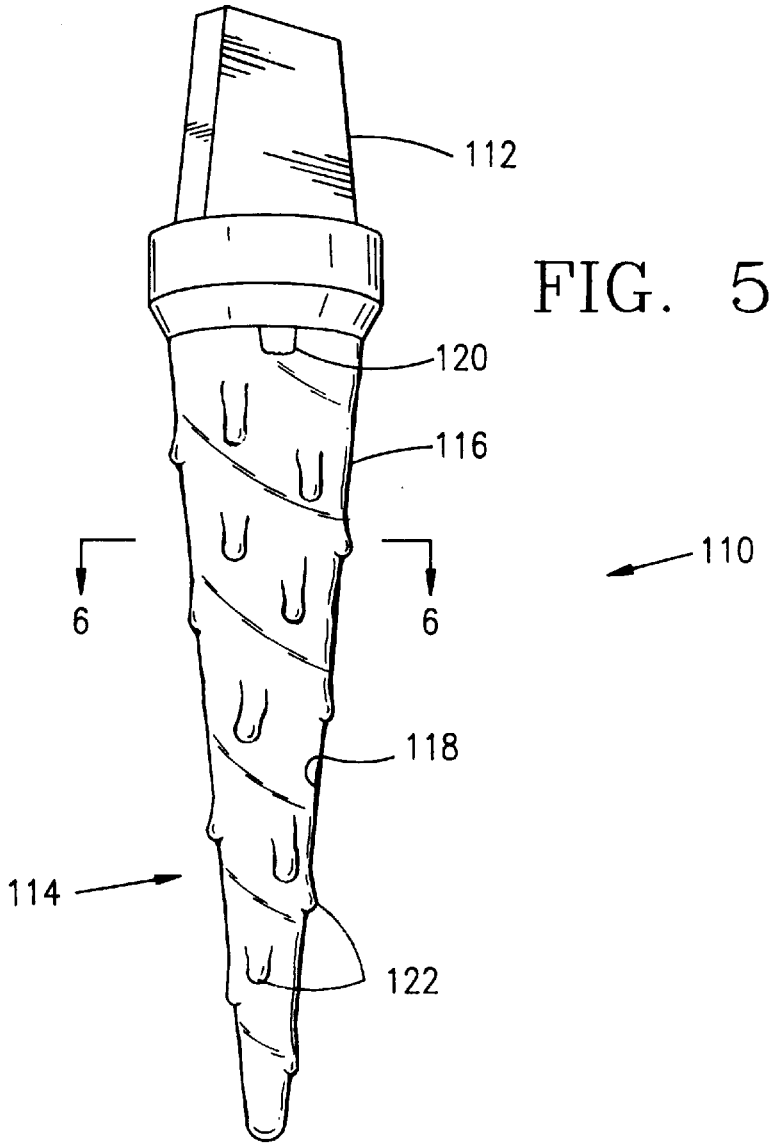
FIG. 5 is a side elevation view of a third embodiment of the present invention incorporating a lamp bulb envelope capable of creating an icicle effect.
Figure 6:
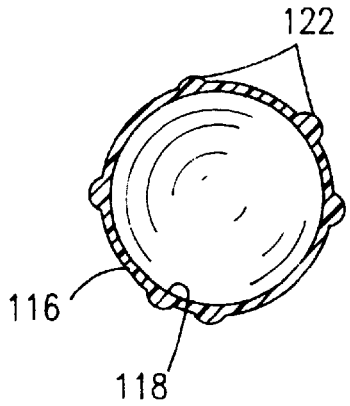
FIG. 6 is a cross-sectional view taken at line 6—6 of FIG. 5.

In another embodiment, illustrated in FIGS. 5 and 6, a lamp 110 having a conventional lamp base 112 includes a lamp bulb envelope generally indicated at 114. The envelope has an outer surface 116 and an inner surface 118, a typical electric filament 120, and a plurality of simulated frozen water runs 122. The lamp base 112 and the filament 120 may be any one of a wide variety of conventional types, as desired. The lamp bulb envelope 114 is hollow, elongated and generally conical, and is similar in shape to that of an icicle. The envelope may be constructed of material such as glass, plastic or the like, and the plurality of frozen water runs 122 on its outer surface 116 may be molded into the surface of the envelope, or otherwise formed, as desired. The envelope is permanently secured to the lamp base 112, in conventional manner.

Figure 7:
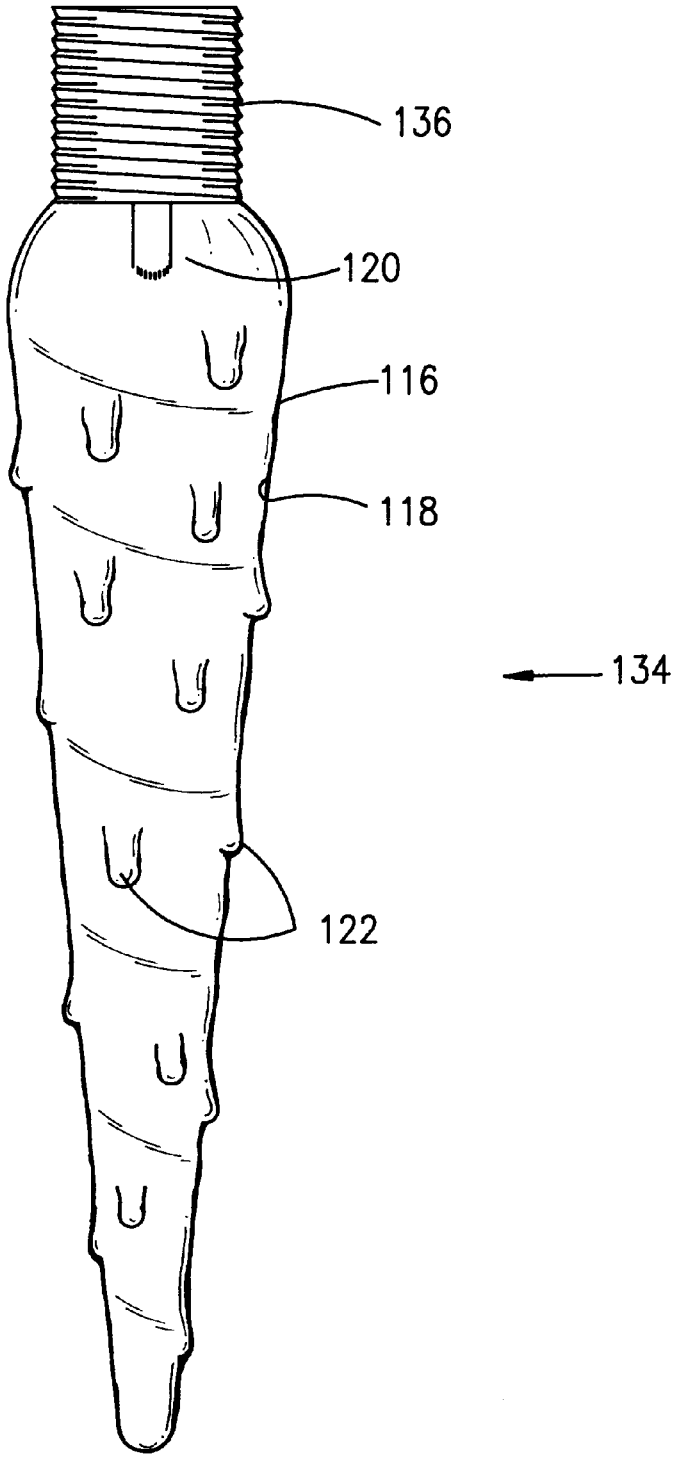
FIG. 7 is a side elevation view of a fourth embodiment of the present invention, illustrating a modified form, shape and size of the lamp bulb envelope of FIG. 5.

FIG. 7 is a side elevation view of another embodiment of the present invention, illustrating a lamp envelope 134 affixed to a base 136 which is conventional, but which differs from base 112 in FIG. 5. This embodiment generally illustrates lamp components having a different form, shape and size than that of FIG. 5, illustrating that the present invention is easily and readily adaptable to be compatible with a wide variety of typical lamp bases. The reference numerals identifying the elements are the same as those used to describe similar elements in FIG. 5 and the descriptions thereof are basically the same.

In operation, light emitted from the typical electric filament 120 is conveyed through the entire length of the lamp bulb envelope 114, thus utilizing the icicle shape to create a dynamic and decorative effect. When viewed from a point external to the lamp bulb envelope 114, the plurality of the simulated frozen water runs 122 on the outer surface 116 which are furthest away and the simulated frozen water runs 122 which are nearest to the external point create the appearance of a real three-dimensional icicle. This created effect, in conjunction with the light emitted from the typical electric filament 120, creates a beautiful and highly pleasing visual effect.

Thus, it will be seen that the lamp envelope and the lamp casing described above are capable of creating icicle effects which provide unique and beautiful articles or products that create highly pleasing visual effects for decorative purposes such as for Christmas trees, eaves, railings, and the like. Although the invention has been described in terms of preferred embodiments, it will be understood that these are exemplary of the invention, and that numerous variations and modifications are possible. For example, the lamp casings can have a wide variety of other shapes, forms and sizes to facilitate compatibility with a wide variety of typical lamp bases. The lamp bulb casings and envelopes can be clear, translucent, frosted, generally smooth or roughened, etched, and the like, as desired. Also they can have transparent, nontransparent, and diffusing regions on their surfaces to enhance the decorative effect. This is facilitated by using various materials, color pigments, abrading, coating, painting, and the like, as desired.

Accordingly, the scope of the present invention is limited only by the following claims.

What is claimed is:

1. A lamp casing for sliding over a lamp bulb to create a desired effect, comprising; a hollow, generally conical single element having a top open neck region that is cylindrical and flanged outwardly at its top end, the neck region having a plurality of flexible, upwardly-extending fingers and open-ended slots downwardly extending from said open top end.

2. The lamp casing according to claim 1, wherein said element is shaped to simulate an icicle.

3. The lamp casing according to claim 1, wherein said element has an outer surface which incorporates a plurality of simulated frozen water runs.

4. The lamp casing according to claim 1, wherein said single element is secured to a lamp by an engaging force produced by flexible fingers formed between said open-ended slots.

5. The lamp casing according to claim 4, wherein said flexible fingers extend upwardly to a first point, bend inwardly to a second point, and then continue upwardly, ending at outwardly facing flanges at said top end.

6. The lamp casing according to claim 1, further including a drain hole at an extreme lower end of said conical element.

7. An article for creating an icicle effect comprising a hollow, elongated, generally conical lamp bulb envelope having a plurality of apparent frozen water runs on its outer surface.

* * * * *